US007066788B2

(12) United States Patent
Rubin et al.

(10) Patent No.: US 7,066,788 B2
(45) Date of Patent: Jun. 27, 2006

(54) ELECTRONIC DIE POSITIONING DEVICE AND METHOD

(75) Inventors: Joseph Rubin, Monterey Park, CA (US); Timothy A. Hazeldine, Irvine, CA (US)

(73) Assignee: Ultra Tec Manufacturing, Inc., Santa Ana, CA (US)

( * ) Notice: Subject to any disclaimer, the term of this patent is extended or adjusted under 35 U.S.C. 154(b) by 0 days.

(21) Appl. No.: 10/985,680

(22) Filed: Nov. 10, 2004

(65) Prior Publication Data

US 2006/0099886 A1 May 11, 2006

(51) Int. Cl.
*B24B 7/22* (2006.01)
*B24B 49/12* (2006.01)

(52) U.S. Cl. ..... 451/6; 451/288

(58) Field of Classification Search ..... 451/6, 451/7, 8, 9, 10, 41, 288, 289; 33/366, 392
See application file for complete search history.

(56) References Cited

U.S. PATENT DOCUMENTS 4,159,422 A * 6/1979 Okubo ..... 250/231.1
4,812,654 A * 3/1989 Araujo ..... 250/338.1
5,337,144 A 8/1994 Strul et al.
5,643,046 A * 7/1997 Katakabe et al. ..... 451/6
5,891,352 A * 4/1999 Litvak ..... 216/85
5,949,927 A * 9/1999 Tang ..... 385/12
6,000,996 A 12/1999 Fujiwara
6,007,409 A 12/1999 Chung
6,075,606 A * 6/2000 Doan ..... 356/630
6,139,403 A 10/2000 Dischiano
6,151,100 A 11/2000 Yamane et al.
6,309,899 B1 10/2001 Mahanpour et al.
6,335,208 B1 1/2002 Lowry
6,368,886 B1 4/2002 Van Broekhoven et al.
6,429,028 B1 8/2002 Young et al.
6,448,801 B1 9/2002 Dischiano
6,483,071 B1 11/2002 Hunter et al.
6,517,666 B1 2/2003 Li et al.
6,573,473 B1 6/2003 Hunter et al.
6,632,124 B1 10/2003 Adams et al.
6,672,947 B1 1/2004 Tsao et al.
6,709,888 B1 3/2004 Nadeau
6,726,528 B1 4/2004 Barbour
2002/0025600 A1 2/2002 Lowry
2004/0014401 A1 1/2004 Tsao et al.

* cited by examiner

*Primary Examiner*—Robert A. Rose
(74) *Attorney, Agent, or Firm*—Fulwider Patton LLP

(57) ABSTRACT

An autocollimator is relied upon to orient an electronic die such that its frontside is parallel to a polishing surface. The polishing device is configured such that a beam of light that is projected by the autocollimator is able to reflect off of the backside surface of the die. Measurement off of the backside surface allows the die's parallelism relative to the polishing surface to be established without removing the die from the polishing surface and allows the die's orientation to be monitored and adjusted while the frontside is being deprocessed.

20 Claims, 3 Drawing Sheets

ELECTRONIC DIE POSITIONING DEVICE AND METHOD

FIELD OF THE INVENTION

The present invention very generally relates to the precise positioning of a workpiece relative to a tool and more particularly pertains to an improvement in the planar removal accuracy of electronic circuitry from the frontside of an electronic die.

BACKGROUND OF THE INVENTION

It is often beneficial to be able to examine the microscopic electronic circuitry that is formed on a semiconductor wafer or more accurately, on an individual die such is commonly encapsulated or packaged in a "chip". Such examination may be required during the development of a new integrated circuit, for controlling quality during the manufacturing process, for failure analysis or for reverse engineering purposes.

Multiple layers of electronic circuitry are formed on the frontside of a semiconductor wafer by a series of processes that are well known in the art. Each wafer includes an array of individual integrated circuits that subsequently separated from one another wherein the wafer is sliced into individual dice so that each includes one such circuit. A plurality of leads are then attached to each die after which such assembly is packaged or encapsulated in a protective case to complete an IC chip. The circuitry that is formed on each individual die includes a plurality of circuit layers that are built up on top of one another. The size of such dice range from about 0.5 mm to about 40 mm on a side, while the thickness ranges from about 0.1 mm to 0.8 mm wherein the thickness of each layer of circuitry is on the order of 1 um.

In order to examine a particular layer of circuitry, the die is "deprocessed" by mechanically or chemo-mechanically polishing its frontside to remove the layers of circuitry that are in place above the layer that is of interest. Polishing is accomplished by causing the face of the die to contact a rotating and oscillating polishing surface or lap. The pressure with which the die is urged against the lap, the softness of the lap, the speed of rotation and oscillation of the lap and the properties of the polishing media are some of the factors that determine the rate at which the die is delayered. Controlling the length of time such delayering process is applied in turn determines the depth of material that is removed. It is of course essential that the frontside face of the die is held parallel to the face of the lap so that the plane defined by the material being removed is parallel to the plane defined by each layer of circuitry. Such parallelism ensures that each successive layer of circuitry becomes exposed in its entirety rather than merely a diagonal slice thereof. The sample may be microscopically examined from time to time during the delayering process to monitor the progress that is being made both in terms of the depth of material that has been removed as well as whether parallelism is being maintained so that the appropriate adjustments can be made.

An approach that has heretofore been relied upon to delayer a die includes use of a fixture to positively maintain the orientation of a workpiece constant while such fixture is moved or floats in the Z direction so as to urge the die against a polishing surface that is rotating and oscillating on the X-Y plane. The die is attached to a flat surface which is tilt adjustable relative to the fixture and hence the polishing surface. Alignment of the die relative to the polishing surface is achieved by measuring the distance from various points on the frontside face of the die to a reference surface with the use of a dial indicator. A number of disadvantages are inherent in such an approach. Firstly, the accuracy of a dial indicator is limited and may not be able to repeatably discern a deviation on the order of a micron across the face of a die. Secondly, the physical contact between the dial indicator and the die that is necessary may disturb or distort the die surface and may thereby adversely affect the accuracy of the measurement. Finally, the die and its fixture must be lifted off of the surface of the lap or even detached from the associated support in order to afford access to the frontside surface of the die to allow the measurements to be made. Replacement of the fixture and reengagement of the lap surface by the die may introduce errors that adversely effect the die's orientation, i.e. its parallelism relative to the polishing surface.

An improved approach is needed that allows a die's frontside surface to be quickly, easily and accurately aligned with a polishing surface. Furthermore, it is highly desirable that the die's parallelism can be adjusted and checked while the polishing surface is engaged so as to eliminate errors that may be introduced in shifting, removing or otherwise manipulating the die and its fixture for the purpose of measuring its alignment. Finally, it is similarly highly desirable for the measurement to be taken without physically engaging the surface of the frontside of the die so as to eliminate any possibility of disturbing the circuitry on the surface of the die and possibly also adversely affecting the accuracy of the measurement.

SUMMARY OF THE INVENTION

The apparatus and method of the present invention overcome the shortcomings of the previously known approaches that have been relied upon to orient a die relative to a lap. More particularly, the present invention enables the frontside surface of a die to be oriented so as to be parallel to a polishing surface quickly, easily and highly accurately. Moreover, this is accomplished without any physical contact with the die surface and while the frontside surface of the die is fully engaged with the polishing surface. The latter feature not only eliminates potential orientation errors that could otherwise be introduced if the die and its fixture had to be removed from engagement with the polishing surface while a measurement of the die's parallelism relative to the polishing surface is taken but additionally allows the orientation of the die to be continuously monitored and adjusted during the delaying process.

The present invention is premised on the realization that the deviation in parallelism between the frontside and backside of a wafer is extremely small and that a die which constitutes only a small portion of such wafer would therefore have a subtended angle or total deviation from parallel that is completely negligible for the purpose of a delayering operation. This realization is exploited by basing all measurements for the purpose of establishing and maintaining parallelism of the frontside of a die with the surface of a polishing surface off of the die's backside surface.

The present invention further provides for the adaptation of optical means to measure the orientation of the backside surface and hence the frontside surface of a die relative to a polishing surface. An autocollimator is employed to project a beam of light onto the polishing surface that is perpendicular to such surface wherein the angle of the projected beam is adjusted so as to be collinear with the reflected beam. The backside surface of the die is then subjected to such beam and the orientation of the die is adjusted such that the reflected beam is again collinear with the projected beam to thereby confirm that the frontside surface of the die is parallel to the polishing surface. The use of an autocollimator has been found to be especially effective for use in this application due to the high reflectivity of the backside surface of a die. The backside surface of a wafer from which the individual dice are sliced, is typically polished in the early stages of the manufacturing process in order to allow it to hold a vacuum and thereby facilitate the wafer's and die's handling during the subsequent manufacturing and assembly steps.

In order to provide access to the backside surface of the die to be delayered, the backside of the die is attached to a workpiece holder directly over a port that is formed therein. An adhesive may be relied upon to attach the die to the workpiece holder. The autocollimator is positioned so as to allow a beam to be projected through the port, to reflect off of the backside surface of the die and to return to the autocollimator. The workpiece holder is tilt adjustable in two directions so as to allow an XY plane to be defined that is perpendicular to the projected beam. Since the beam is reflected directly off of the die, any deviation in parallelism between the die and the workpiece holder surface, such as may be due to an uneven distribution of adhesive between the die and the holder, is rendered irrelevant.

A number of different apparatus configurations may be adapted to take advantage of the present invention. The most preferred comprises an apparatus that includes a jig that floats directly on the polishing surface that in turn supports a workpiece holder that is slidingly and concentrically supported therein so as to allow the die that is attached to the bottom of the workpiece holder to similarly float on the polishing surface. The workpiece holder is tilt adjustable relative to the jig and configured to allow an autocollimator to project a beam through its center to and through the port formed in its base to the backside surface of a die attached thereto. Alternatively, the workpiece holder may non-slidingly attached to the jig while the jig is in turn slidingly supported over the polishing surface by an adjacent support column. The workpiece holder is tilt adjustable relative to the jig and is configured such that its bottom surface projects beyond the base of the jig to thereby allow a die attached thereto to float on the polishing surface. The jig and workpiece holder are configured to allow a beam projected from an autocollimator that is positioned thereover to reflect off of the backside surface of the die. Alternatively, the apparatus may be configured so as to position the autocollimator underneath a tilt table that has a port formed therein. The backside surface of die that is attached to the top surface of the tilt table is thereby accessible to the beam generated by the autocollimator while a polishing surface floats on the die's frontside surface.

Any such polishing apparatus may be adapted such that the tilt adjustment is performed automatically when a deviation from a collinear relationship between the autocollimator's projected and reflected beam is detected. A controller may be relied upon to detect any deviation from a concentric projection pattern and activate the appropriate tilt control whereby well known feedback logic is employed to achieve alignment. Such automation may be employed to initially align the die relative to the polishing surface and maintain alignment throughout the polishing process.

These and other advantages of the present invention will become apparent from the following detail description of preferred embodiments which, taken in conjunction with the drawings, illustrate by way of example the principles of the invention.

DETAILED DESCRIPTION OF PREFERRED EMBODIMENTS

The Figures generally illustrate adaptations of various polishing device configurations so as to take advantage of the present invention. Each apparatus includes a mounting surface to which the backside surface of a die is attached and wherein such mounting surface has a port formed therein so as to a beam projected by an autocollimator to be reflected off of the backside surface of the die. The method of practicing the invention is substantially the same for all apparatus embodiments. The angle of the beam projected by the autocollimator is first aimed so as to be perpendicular to the polishing surface after which the die, attached to the die holder, is brought into position within said beam and tilt adjusted such that its backside surface is perpendicular to the autocollimator's projected beam.

Figure 1:
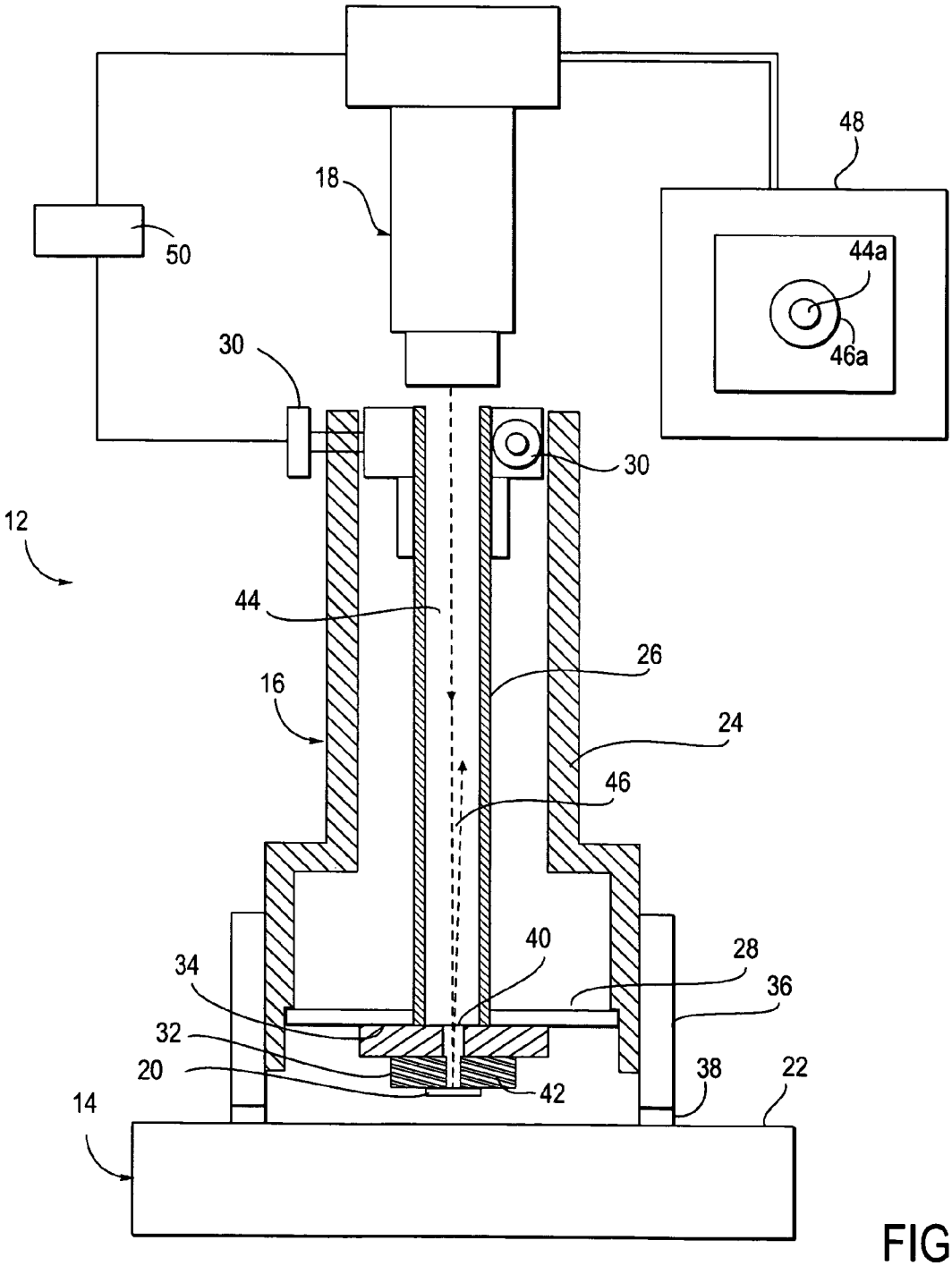
FIG. 1 is a schematic view of a preferred embodiment of the present invention.

FIG. 1 is a schematic representation of a preferred embodiment of the present invention. The deprocessing apparatus 12 generally includes a polishing mechanism 14, a jig 16 for supporting the workpiece and an autocollimator 18. The general configuration and interaction of the polishing mechanism and jig combination are well known in the art as such devices are readily commercially available. The workpiece in the form of the die 20 is supported by the jig which is configured to allow the frontside of the die to float directly on the polishing surface 22. The polishing surface is rotated while the jig is oscillated back and forth across the polishing surface by a control arm (not shown). The jig includes a rigid housing 24 that surrounds a centrally positioned support tube 26. The tube is centered at one end by a tilt diaphragm 28 and is supported at it opposite end by a two plane tilt adjusting mechanism 30. The die is attached to the sample holder 32 with the use of an adhesive while the sample holder is removably attached to the base element 34 of the support tube. A Z-limit ring 36 having a series of ceramic support feet 38 disposed about its base allows the jig to float on the polishing surface while maintaining the jig in a substantially perpendicular orientation thereto and allowing the die float to float thereon. Any deviation from parallel of the die relative to the polish surface is compensated for by manipulation of the tilt adjustment knobs.

The present invention provides for a port 40 that is formed in the base element 34 of the support column 26 as well as a port 42 that is formed in the sample holder 32. An autocollimator 18 is positioned over the jig 16 such that a projected beam 44 emanating therefrom has access to the backside surface of a die 20 that is mounted to the bottom surface of the sample holder and that the reflected beam 46 is able to return to the autocollimator. Autocollimators are well known and are readily commercially available. The autocollimator has provisions for aiming the projected beam and allows the alignment of the projected and reflected beams to be compared such as by viewing through an eyepiece or on a video screen 48. As is shown in FIG. 1, the cross-sectional image of the two beams 44*a*, 46*a* are displayed wherein a concentric relationship would indicate that the two beams are collinear. Collinearity can of course be achieved by changing the angle of the projected beam or the orientation of the reflective surface so as to change the angle of the reflected beam.

Additionally included in FIG. 1 is a schematic representing the automatization of the device wherein a controller 50 is employed to compare the positions of the two images 44*a*, 46*a*, calculate the tilt adjustment that is necessary in order to bring the two images into a concentric alignment and manipulate the tilt adjusting mechanism 30 accordingly. A simple feedback mechanism can be relied upon to maintain such alignment at all times.

In use, the autocollimator 18 is first called upon to project a beam 44 directly upon the polishing surface 22, wherein an optical flat (not shown) may temporarily be placed on the polishing surface in order to enhance reflectivity. The projected beam is aimed such that reflected beam 46 is collinear as is evidence by a concentric alignment of their cross-sectional images 44*a*, 46*a*. The sample die 20 is adhered to the sample holder 32 with the use of for example a suitable wax, such as glycol phthalate, which provides sufficient holding strength, has a conveniently low melting temperature and may be removed with a solvent such as acetone. Such solvent may be used to remove any wax that may obscure that portion of the polished backside surface of the that is visible through the port 42 formed in the sample holder. The sample holder is then attached to the base element 34 of the support tube 26 to allow the beam projected by the autocollimator to reflect off of the backside surface of the die. Any deviation from a concentric alignment of the projected and reflected beam images is compensated for by manipulation of the tilt adjustment mechanism 30, either manually or automatically. Concentric beam images indicate a collinear orientation of the projected 44 and reflected 46 beams which in turn are indicative that the backside surface of the die is perpendicular to the beams and that the frontside of the die is therefore parallel with the polishing surface. The orientation of the die can periodically or continuously be monitored during the deprocessing operation as the die's frontside floats on the rotating polishing surface and the jig is swept back and forth across it.

Figure 2:
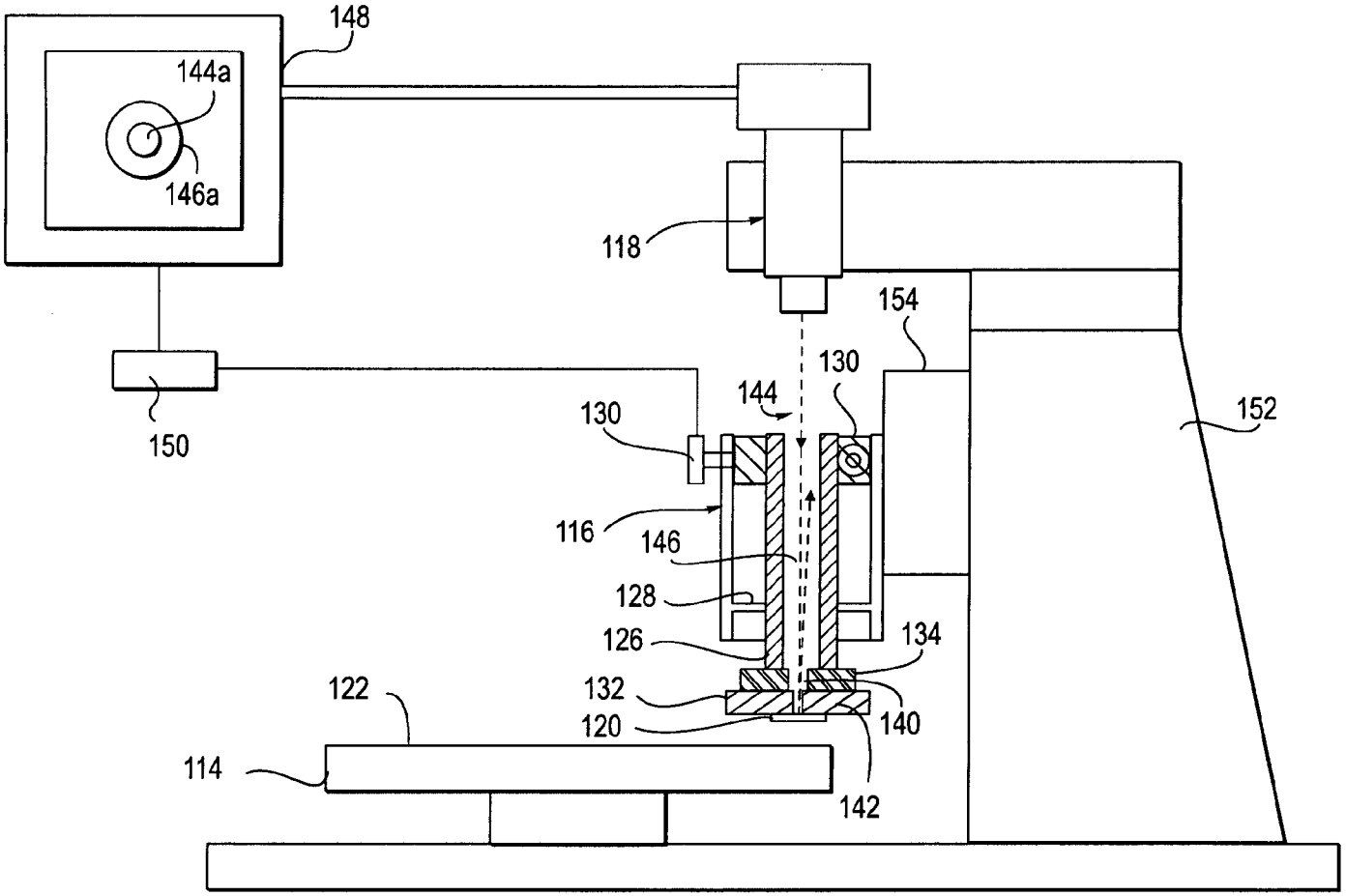
FIG. 2 is a schematic view of alternative preferred embodiment of the present invention.

FIG. 2 illustrates an alternative embodiment of the present invention to the extent that the use of a autocollimator has been adapted for use with a different polishing device configuration. Rather than floating directly on lap surface 122, the jig 116 is supported by a support member 152 that includes a guide element 154 that constrains movement of the jig to the Z axis to allow the die 120 to float directly on the polishing surface. The die is similarly attached to a sample holder 132 that is in turn removably attached to the base element 134 of support column 126. A flex diaphragm 128 serves to center the lower end of the support column while a tilt adjustment mechanism 130 supports the upper end of the column so as to allow its slight repositioning in the XY plane. The support member 152 also supports the autocollimator 118 above the jig. Ports 140 and 142 respectively formed in the base element 134 and sample holder 132 allow the projected beam 144 to reflect off of the backside surface of the die to return to the autocollimator. A viewing monitor 148 allows the alignment of the images 144*a*, 146*a* of the projected 144 and reflected beams 146 to be compared. A controller 150 may optionally be included to automatically manipulate the tilt adjustment mechanism to bring about and/or maintain the two images in concentric alignment.

In use, the autocollimator 118 is first called upon to project a beam 144 directly upon the polishing surface 122, wherein an optical flat (not shown) may temporarily be placed on the polishing surface in order to enhance reflectivity. The projected beam is aimed such that reflected beam 146 is collinear as is evidence by a concentric alignment of their cross-sectional images 144*a*, 146*a*. The sample die 120 is adhered to the sample holder 132 with the use of for example a suitable wax, such as glycol phthalate, which provides sufficient holding strength, has a conveniently low melting temperature and may be removed with a solvent such as acetone. Such solvent may be used to remove any wax that may obscure that portion of the polished backside surface of the that is visible through the port 142 formed in the sample holder. The sample holder is then attached to the base element 134 of the support tube 126 to allow the beam projected by the autocollimator to reflect off of the backside surface of the die. Any deviation from a concentric alignment of the projected and reflected beam images is compensated for by manipulation of the tilt adjustment mechanism 130, either manually or automatically. Concentric beam images indicate a collinear orientation of the projected 144 and reflected 146 beams which in turn are indicative that the backside surface of the die is perpendicular to the beams and that the frontside of the die is therefore parallel with the polishing surface. The orientation of the die can periodically or continuously be monitored during the deprocessing operation as the die's frontside floats on the rotating polishing surface that may additionally shift position in the XY plane.

Figure 3:
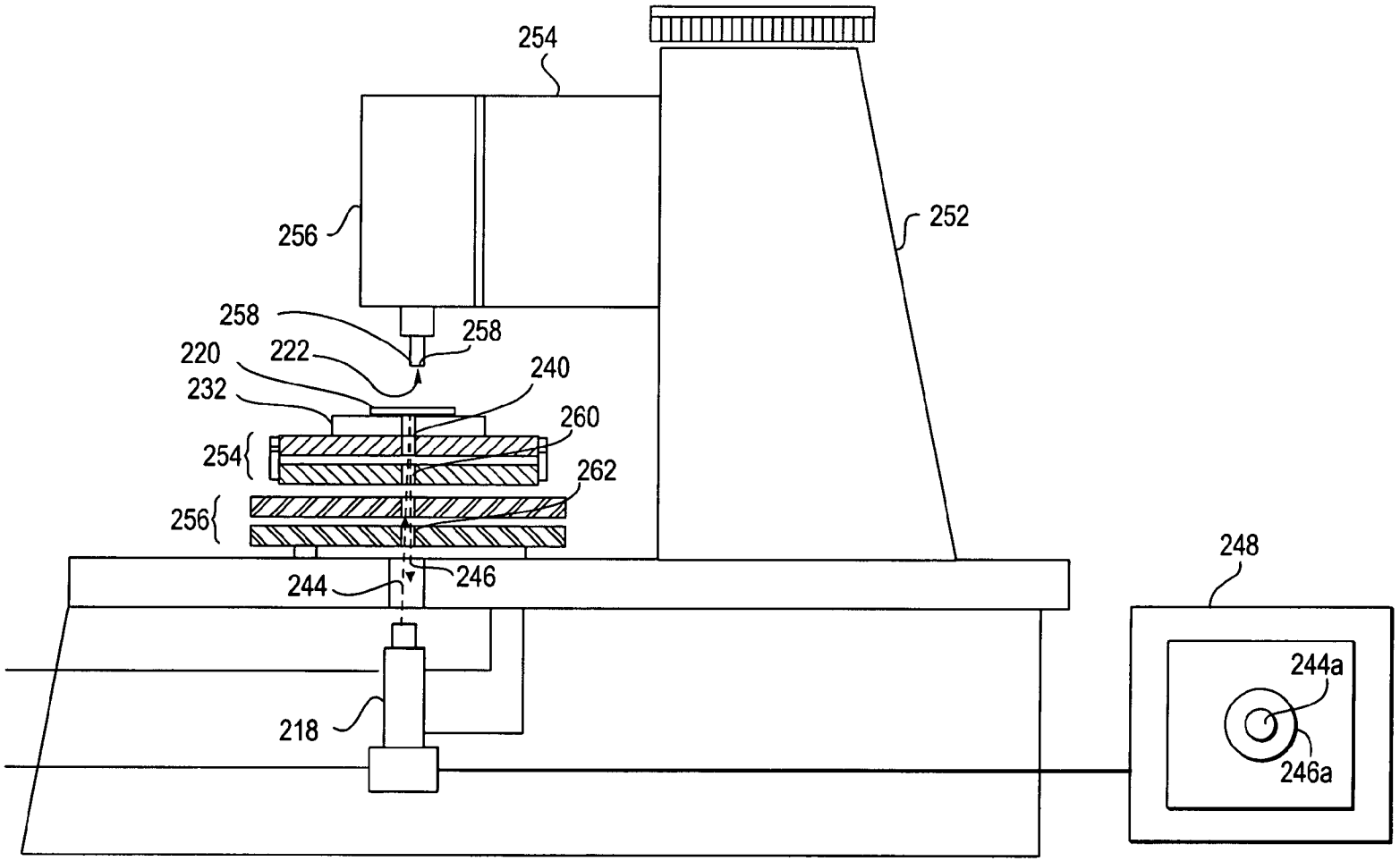
FIG. 3 is a schematic view of a further alternative preferred embodiment of the present invention.

FIG. 3 illustrates another alternative embodiment of the present invention to the extent that the use of a autocollimator has been adapted for use with a different polishing device configuration, more specifically, a "Selected Area Preparation Type" device as is well known in the art and as is commercially available. In such embodiment, the sample 220 is attached to a sample holder 232 that is in turn supported by an adjustable tilt table 254 which is in turn supported by an oscillating table 256. An adjacently positioned support member 252 supports guide member 254 that constrains the movement of a drive mechanism along the Z axis. A rotating tool 258 that includes a cutting surface 222 is powered thereby and is positioned to float directly on the frontside of the sample die. Ports 240, 260, 262 respectively formed in the sample holder, tilt table and oscillating table provide access to the backside surface of the sample die such that a projected beam 244 is reflected 246 back to the autocollimator 218 that is situated below the sample and polishing device. A monitored 248 serves to display the cross-sectional images 244*a*, 246*a* of the two beams as an indication of the parallelism of the die relative to the plane defined by the rotating tool.

In use, the autocollimator 218 is first called upon to project a beam 244 directly upon the cutting surface 222 of the cutting tool, wherein an optical flat (not shown) may be temporarily placed on the cutting surface in order to enhance reflectivity. The projected beam is aimed such that reflected beam 246 is collinear as is evidence by a concentric alignment of their cross-sectional images 244*a*, 246*a*. The sample die 220 is adhered to the sample holder 232 with the use of for example a suitable wax, such as glycol phthalate, which provides sufficient holding strength, has a conveniently low melting temperature and may be removed with a solvent such as acetone. Such solvent may be used to remove any wax that may obscure that portion of the polished backside surface of the that is visible through the port 42 formed in the sample holder. The sample holder is then attached to the top of the tilt table 254 to allow the beam projected by the autocollimator to reflect off of the backside surface of the die. Any deviation from a concentric alignment of the projected and reflected beam images is compensated for by manipulation of the tilt adjustment mechanism associated with the tilt table, either manually or automatically. Concentric beam images indicate a collinear orientation of the projected 244 and reflected 246 beams which in turn are indicative that the backside surface of the die is perpendicular to the beams and that the frontside of the die is therefore parallel with the cutting surface. The orientation of the die can periodically or continuously be monitored during the deprocessing operation as the cutting tool floats on the die's frontside and while the oscillating shifts the die in the X and Y directions.

While particular forms of this invention have been described and illustrated, it will also be apparent to those skilled in the art that various modifications can be made without departing from the spirit and scope of the invention. More particularly, any of various polishing devices can be adapted such that an autocollimator is relied upon to measure the parallelism of the plane defined by backside surface of an electronic die relative to the plane defined by a polishing surface or tool. Accordingly, it is not intended that the invention be limited except by the appended claims.

What is claimed is:

1. An apparatus for deprocessing the frontside of a semiconductor die, comprising:

a polishing surface defining a plane;

an autocollimator capable of aiming a beam of light toward said polishing surface such that said beam is perpendicular to said polishing surface; and a sample holder configured for supporting a semiconductor die having a frontside surface and a backside surface so as to allow its frontside surface to engage said polishing surface while the backside surface of such die is exposed to said beam, wherein said holder is tilt adjustable so as to enable the backside surface of such die to assume an orientation that is perpendicular to said beam and wherein said holder is movable relative to said polishing surface so as to enable the frontside surface of said die to engage said polishing surface while its backside surface is supported in said perpendicular orientation.

2. The apparatus of claim 1, wherein said sample holder includes a surface for engaging the backside of a die and said surface has a port formed therein to enable the beam projected by said autocollimator to reflect off of the backside surface of the die.

3. The apparatus of claim 2, wherein said sample holder is supported by a jig and said sample holder is tilt adjustable relative to said jig.

4. The apparatus of claim 3, wherein said jig is configured to float directly on said polishing surface.

5. The apparatus of claim 4, wherein said sample holder is slidably supported by said jig and is configured to enable a die supported thereby to float directly on said polishing surface.

6. The apparatus of claim 3, wherein said jig is slidably supported by a support element.

7. The apparatus of claim 6, wherein said sample holder is non-slidably supported by said jig and is configured to enable a die supported thereby to float directly on said polishing surface.

8. The apparatus of claim 2, wherein said collimator is positioned so as to project a beam from above a die supported by said sample holder.

9. The apparatus of claim 2, wherein said collimator is positioned so as to project a beam from below a die supported by said sample holder.

10. The apparatus of claim 9, further comprising a mechanism for automatically tilt adjusting said die while the frontside of the die engages the polishing surface so as to maintain the backside surface of the die in said perpendicular orientation relative to said beam during a deprocessing operation.

11. A method for deprocessing the frontside of an electronic die having a frontside surface and a backside surface, comprising:

providing a planar polishing surface;

providing an autocollimator configured for projecting a beam of light;

projecting said beam toward said polishing surface so as to be perpendicular to said polishing surface;

supporting an electronic die such that its backside surface intercepts said beam;

causing said die to assume an orientation wherein its backside surface is perpendicular to said beam;

causing the frontside surface of said die to engage said polishing surface while the backside surface is in said perpendicular orientation; and inducing relative movement between said polishing surface and the die to thereby cause the frontside of the die to become deprocessed.

12. The method of claim 11, wherein said electronic die is supported by a sample holder by adhering the backside surface of the die thereto.

13. The method of claim 12, wherein a wax is used to adhere the die to the sample holder.

14. The method of claim 12, further comprising automatically and continuously maintaining said backside surface in said perpendicular orientation while the frontside is being deprocessed.

15. The method of claim 11, wherein said sample holder has a port formed therein to enable said beam to reflect off of the backside surface of the die.

16. A method for deprocessing the frontside of an electronic die, comprising:

providing a planar polishing surface;

providing an autocollimator configured for projecting a beam of light, receiving a reflection thereof and comparing the alignment of the projected and reflected beams;

projecting said beam of light toward the polishing surface and aiming said beam such that the reflected beam is collinear with the projected beam;

positioning an electronic die, having a frontside surface and a backside surface, in said projected beam such that said beam is reflected off of the backside surface of said die;

orienting said die so as to assume an orientation wherein such reflected beam is collinear with said projected beam;

causing the frontside surface of the die to engage said polishing surface while in said orientation; and inducing relative movement between said polishing surface and the die to thereby cause the frontside of the die to become deprocessed.

17. The method of claim 16, further comprising automatically and continuously maintaining said backside surface in said orientation while the frontside is being deprocessed.

18. The method of claim 16, wherein said die is adhered to a sample holder having a port formed therein positioned so as to allow said projected beam and reflected beam pass therethrough.

19. The method of claim 18, wherein said backside surface of said die faces upwardly.

20. The method of claim 18, wherein said backside surface of said die faces downwardly.

* * * * *